United States Patent [19]

Hood et al.

[11] 4,057,023

[45] Nov. 8, 1977

[54] HALYARD RIG FOR ROLL-FURLING MAINSAIL

[75] Inventors: Frederick E. Hood; Donald K. Mitchell; Gary S. Uhring, all of Marblehead, Mass.

[73] Assignee: Hood Sailmakers, Inc., Marblehead, Mass.

[21] Appl. No.: 718,685

[22] Filed: Aug. 30, 1976

[51] Int. Cl.[2] ..... B63H 9/04

[52] U.S. Cl. ..... 114/107; 114/90

[58] Field of Search ..... 114/90, 102, 104–108, 114/112

[56] References Cited

U.S. PATENT DOCUMENTS

| | | | |
|---|---|---|---|
| 591,446 | 10/1897 | Worthen | 114/112 |
| 3,343,514 | 9/1967 | Brett | 114/108 |
| 3,835,804 | 9/1974 | Jackson | 114/107 |
| 3,851,610 | 12/1974 | Greene | 114/106 |

*Primary Examiner*—Trygve M. Blix
*Assistant Examiner*—Stuart M. Goldstein
*Attorney, Agent, or Firm*—Kenway & Jenney

[57] ABSTRACT

In the mainsail roll-furling system disclosed herein, the mainsail is roller-furled inside a tubular compartment in the mast itself, the sail being drawn out through an aft-facing slot in the mast. A swivel is utilized between the halyard and the luff of the mainsail and a guide is provided on the halyard side of the swivel which both positively prevents rotation of the halyard during furling of the sail and positions the upper end of the sail luff essentially in the middle of the sail storage compartment.

1 Claim, 3 Drawing Figures

HALYARD RIG FOR ROLL-FURLING MAINSAIL

BACKGROUND OF THE INVENTION

The present invention relates to a mainsail which roller-furls within a mast and more particularly to a halyard system for use with such a sail system.

Among the several objects of the present invention may be noted the provision of a roller-furling mainsail which is self-storing within a hollow mast; the provision of such a mainsail which may be relatively easily deployed or re-furled; the provision of such a mainsail system which is free from jamming; the provision of such a mainsail which may be relatively easily raised and exchanged; the provision of such a mainsail-furling system which is highly reliable and which is of relatively simple and inexpensive construction. Other objects and features will be in part apparent and in part pointed out hereinafter.

SUMMARY OF THE INVENTION

Briefly, the present invention relates to a sailboat having a mainsail which roll-furls on its luff edge so as to be self-storing within a hollow mast, the mast having an aft-facing slot through which the mainsail can be drawn. The luff edge of the mainsail is raised within the mast by a halyard system which includes a sheave at the top of the mast which directs a halyard centrally down into the sail storage space and which includes also a swivel for joining the halyard to the luff edge of the mainsail. The swivel has a lower portion which attaches to and is freely rotatable with the luff edge of the mainsail while the upper portion of the swivel includes a laterally projecting finger or guide which extends aft through the slot and positively prevents twisting of the halyard during roller-furling of the mainsail. Preferably, the finger or guide is grooved so as to engage the side walls of the slot, the length of the guide being such that the swivel is thereby centered within the sail-storing compartment so as to minimize binding of the sail during roller-furling.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
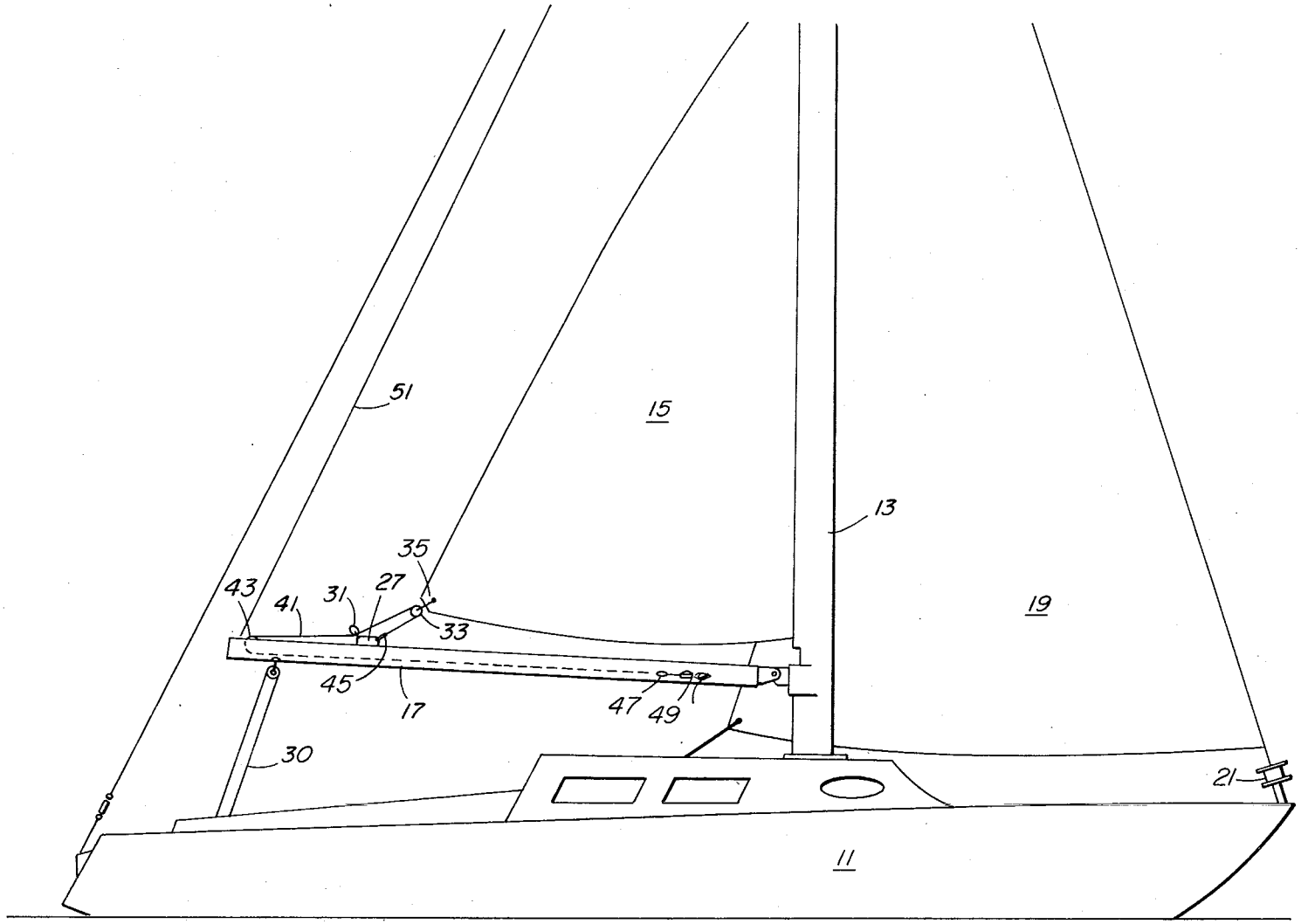
FIG. 1 is a side view of a cruising type auxiliary sailboat having a roll-furling mainsail.

Referring now to FIG. 1, there is indicated at 11 the hull of a cruising type auxiliary sailboat having a conventionally stayed mast adapted for internal mainsail furling, e.g. as described in U.S. Pat. No. 3,835,804, issued Sept. 17, 1974 to Patrick T. Jackson of Boothbay Harbor, Maine. As described in that patent, the mainsail roller furls along its luff edge within a compartment in the mast and exits from that compartment through an aft-facing slot. The mainsail, designated 15, is loose-footed and is trimmed to a boom 17, the boom itself being controlled by a conventional sheet 30.

In particular, the clew of the mainsail 15 is secured to a car which is freely slidable along the length of the boom. The car, designated 27, is of a construction which is essentially conventional for travellers and the like, e.g. employing roller-bearing wheels adapted to roll along a track integrally extruded with the boom 17. The car 23 carries a first block 31 while a second block 33 is attached to the clew 35 of the mainsail 15.

Figure 2:
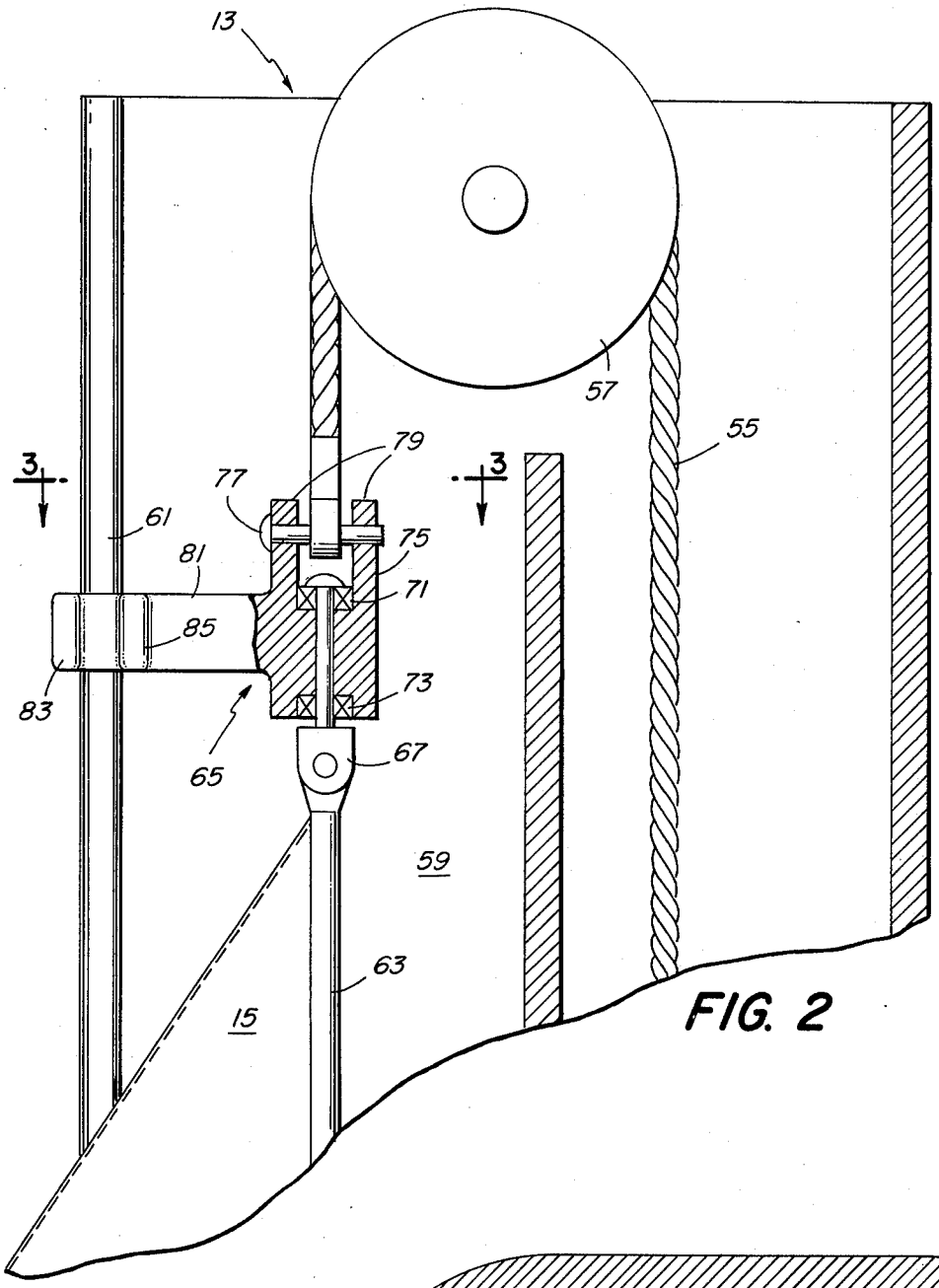
FIG. 2 is a side view to an enlarged scale and with parts broken away, showing the mast head arrangement of the sailboat of FIG. 1, including the halyard system of the present invention.

An outhaul line 41 is rigged to pull aft from the tip of the boom by means of a sheave 43 journaled at the boom tip. From the sheave 43, the outhaul line 41 passes forward and through the block 31 on the car 27, thence through the block 33 on the clew of the sail and then back to the car 27 where it is secured, e.g. by a shackle as indicated at 45. For ease in adjustment, the control end of the outhaul line 41 is preferably led forward inside the boom as shown in FIG. 2 to a feedthrough 47 and a cleat 49 where it may be adjustably secured. Preferably, the boom 17 is also provided with a topping lift, indicated at 51 in FIG. 1, which is fed over a second sheave mounted parallel to the outhaul sheave 43, the topping lift then also being led forward inside the boom where it may be conveniently secured near the gooseneck.

An advantage of this form of rigging for the mainsail clew is that the position of the car 27 does not have to be independently controlled in a manner which would require additional control lines. Rather, the car 27 is freely slidable along the boom and is acted upon by a balance of forces which urge the car to a position automatically providing an appropriate drawing angle for shaping the mainsail.

The boat is also provided with a jib 19 and, in order to provide the maximum flexibility in ease of setting and furling sail area, this jib is preferably also provided with conventional jib furling gear, as indicated diagrammatically at 21.

As will be understood from the general proportions of FIG. 1, the mainsail is, in that drawing, shown in a substantially furled position, i.e. with the working area of the sail substantially reduced. Such a partially furled attitude might be suitable for sailing in quite heavy winds. Under lighter wind conditions, however, the outhaul line can be tightened while letting off of the roller-furling apparatus.

The luff edge of the mainsail 15 incorporates a wire or rod which is tensioned between a furling drum or reel near the base of the mast and a halyard used for initially hoisting the sail. A gooseneck fitting, incorporating a preferred form of roller-furling drum construction, is described in greater detail in a co-assigned U.S. patent application entitled, Boom Gooseneck Fitting Providing Mainsail Roller-Furling, being filed on essentially even date with the present application. Accordingly, this construction is not described in greater detail herein.

Figure 3:
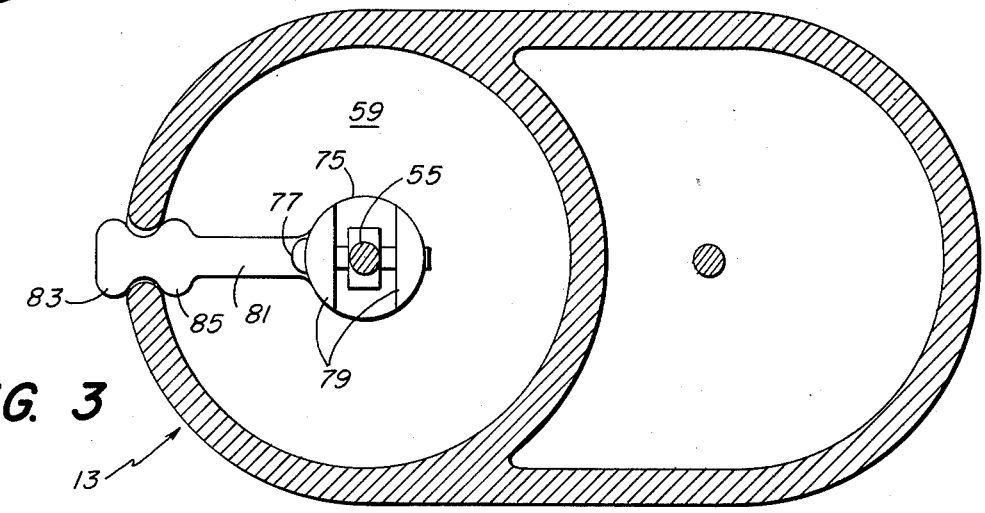
FIG. 3 is a top sectional view taken substantially on the line 3—3 of FIG. 2 showing the guide finger used with the halyard swivel.

The halyard attachment to the luff edge of the mainsail is illustrated in greater detail in FIGS. 2 and 3. As may be seen in FIG. 2, a halyard 55 passes over a sheave 57 so as to be led generally downwardly into a generally cylindrical sail storage cavity or compartment 59 in the mast 13. The sail storage cavity incorporates an aft-facing slot 61 through which the sail may be drawn out for unfurling.

As is conventional, a relatively heavy luff wire or rod 63 is sewn into the mainsail 15 to provide torsional stiffness for roll-furling. The luff wire 63 is connected to the halyard 55 by means of a swivel assembly, designated generally as 65. The central portion of the swivel is connected to the upper end of the luff wire by means of a clevis 67. The center and lower portion of the swivel assembly are supported in bearings 71 and 73 set in the outer or upper portion of the swivel assembly, this portion being designated 75, so the clevis can rotate freely with the luff wire 63 as the mainsail 15 is roller-furled. The halyard 55 is attached to this housing portion of the swivel assembly by means of a pin 77 which extends through a pair of lugs 79 projecting upwardly from the housing 75.

Even though the bearings 71 and 73 are of a low friction type of construction, it will be understood that, due to the typically high tension on the luff wire 63, some torque will necessarily be transmitted to the halyard 55 during furling. This torque can twist the halyard and tend to develop a binding or jamming tendency.

Extending aft from the housing portion 75 is a finger-like guide or extension 81 which extends into the slot 61. Preferably, the finger or extension 81 is ribbed, as indicated at 83 and 85, so as to interlock with the opposed sides of the slot 61. Accordingly, in addition to positively preventing rotation of the halyard when the mainsail 15 is furled around the luff wire 63, the engagement of the extension 81 with the sides of the slot 61 serves to position the luff wire 63 essentially centrally within the sail storage cavity 59 to prevent it from pulling over next to the slot and causing binding and jamming.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In a sailboat having a mainsail which roll-furls on its luff edge so as to be self-storing within a hollow mast, the mast having an aft-facing slot through which the mainsail can be drawn, a halyard system comprising:

a sheave at the top of the mast which directs a halyard centrally down into the sail-storing space; and a swivel fitting for joining the halyard to the luff edge of the mainsail, said swivel having a lower portion which attaches to and is freely rotatable with the luff edge of the mainsail and an upper portion which attaches to the halyard and includes a laterally projecting guide which extends aft through said slot and prevents twisting of the halyard during roller furling of said mainsail, said guide including ribs which engage the edges of said slot so as to limit fore and aft movement of the swivel and thereby locate the luff edge of the mainsail essentially centrally within the mast hollow.

* * * * *